US007036551B2

(12) United States Patent
Anzai et al.

(10) Patent No.: US 7,036,551 B2
(45) **Date of Patent: *May 2, 2006**

(54) METHOD OF MOLDING LOW MELTING POINT METAL ALLOY

(75) Inventors: Kazuo Anzai, Nagano-ken (JP); Koji Takei, Nagano-ken (JP); Ko Yamazaki, Nagano-ken (JP)

(73) Assignee: Nissei Plastics Industrial Co., Ltd., Nagano-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/066,598

(22) Filed: Feb. 25, 2005

(65) Prior Publication Data

US 2005/0194116 A1 Sep. 8, 2005

(30) Foreign Application Priority Data

Feb. 27, 2004 (JP) ..... 2004-055055

(51) Int. Cl.
*B22D 17/08* (2006.01)
*B22D 23/00* (2006.01)
*B22D 25/00* (2006.01)

(52) U.S. Cl. ..... 164/113; 164/900

(58) Field of Classification Search ..... 164/113, 164/900

See application file for complete search history.

(56) References Cited

U.S. PATENT DOCUMENTS

2001/0020526 A1 9/2001 Motegi et al.
2004/0182537 A1* 9/2004 Takizawa et al. ..... 164/113

FOREIGN PATENT DOCUMENTS

JP 2001-252759 9/2001
JP 2003-200249 7/2003

* cited by examiner

*Primary Examiner*—Kuang Y. Lin
(74) *Attorney, Agent, or Firm*—Weingarten, Schurgin, Gagnebin & Lebovici LLP

(57) ABSTRACT

The present invention relates to a method of molding a low-melting-point metal alloy which exhibits thixotropy properties in a solid-phase and liquid-phase coexisting temperature region. In this method, a temperature of a heating holding cylinder is increased to a liquidus temperature or higher at the start of a molding operation. Then a remaining material in the preceding molding remaining in the heating holding cylinder in a solid state is wholly melted. After that a temperature of the heating holding cylinder is lowered to a temperature in the solid-phase and a liquid-phase coexisting temperature region. At the same time a molding material is supplied and a provisional molding is carried out. After the temperature has reached the solid-phase and liquid-phase coexisting temperature region, a regular molding is started. By the present invention a problem of a remaining material in the heating holding cylinder, which becomes a trouble at the start of molding by injection, is solved.

2 Claims, 2 Drawing Sheets

METHOD OF MOLDING LOW MELTING POINT METAL ALLOY

This application claims priority to a Japanese application No. 2004-055055 filed Feb. 27, 2004.

BACKGROUND OF THE INVENTION

1. Field of the Invention

The present invention relates to a method of molding a low melting point metal alloy such as a magnesium alloy, an aluminum alloy or the like using a metallic raw material, which exhibits thixotropy properties in a solid-phase and liquid-phase coexisting temperature region.

2. Description of the Related Art

A method of molding a magnesium alloy comprises the steps of melting a metallic raw material into a liquid alloy at a liquidus temperature or higher, causing the obtained liquid alloy to flow downward on a surface of an inclined cooling plate to cool the alloy rapidly in a semi-molten metal state, holding the semi-molten metal alloy in a storage tank at a temperature in a solid-phase and liquid-phase coexisting temperature region to form a metal slurry (semisolid) having thixotropy properties, casting the metal slurry to a metallic raw material potentially having thixotropy, heating this metallic raw material in a semi-molten metal state with an injection device, and injecting the heated metallic raw material into a mold to mold the material into an article while accumulating the heated metallic raw material.

Further as a molding means for a magnesium alloy or the like, a means is known that it includes a heating means on an outer circumference of a cylinder body having a nozzle opening at the end, and supplies a metallic material in a thixotropy state to a molten metal holding cylinder (heating holding cylinder) in an end portion of which a measuring chamber connected to the nozzle opening is formed with diameter reduced while the metallic material being accumulated therein, and then injects the metallic material into a mold after measuring the metallic material by forward and backward movements of an internal injection plunger.

The above-mentioned related arts are disclosed in Japanese Laid-Open Patent Publications No. 2001-252759 and No. 2003-200249.

A semisolid material, which exhibits thixotropy properties in a solid-phase and liquid-phase coexisting temperature region, has a fluidity of a low viscosity by coexistence of a liquid phase and finely spheroid solid phase. This semisolid material is heated at a temperature in a solid-phase and liquid-phase coexisting temperature region because thixotropy properties must be kept until the material is injected. Since the solid phase grows with the passage of time even at a temperature in the solid-phase and liquid-phase coexisting temperature region, a solid-phase fraction is increased with the passage of time and the density of the solid phase is increased so that the fluidity is lowered. Therefore, the injection of accumulated semisolid material is preferably carried out within allowable time.

When the molding operation of such a semisolid material is finished without discharging the material at the end of molding, the solid phase continues to grow until the semisolid material reaches a solidus temperature whereby the semisolid material becomes a solid. Even if the solid is again heated to the temperature in the solid-phase and liquid-phase coexisting temperature region to be in a semi-molten metal state, since a once grown solid phase is not changed small, the solid does not return to an original semisolid material, which exhibits thixotropy properties whereby it becomes a semisolid material, which has a high viscosity and an extremely low fluidity. Thus the injection of the semisolid material becomes impossible as it stands.

To solve this problem the remaining semisolid material should be discharged by repeating injection operation at the end of molding. However, even if the injection of the remaining semisolid material is repeated in a semisolid state, a part of the material is often adhered to an inner wall surface of the heating holding cylinder, the injection plunger or the like. This adhered material is not melted at a temperature in the solid-phase and liquid-phase coexisting temperature region. Thus, when a new material is supplied without removing an adhered material and a molding operation of the material is started, scuffing of the adhered material into the injection plunger, clogging or the like is caused. Accordingly, the heating holding cylinder must be heated to a liquidus temperature or higher to melt and discharge the adhered material before the starting of molding.

SUMMARY OF THE INVENTION

The object of the present invention is to provide a new method of molding a low melting point metal alloy in which even if the remaining semisolid material at the end of the above-mentioned molding operation remains in a heating holding cylinder in a solid state, a molding of a metallic material, which exhibits thixotropy properties in a solid-phase and liquid-phase coexisting temperature region, can be started by temporarily molding the solid in a wholly molten metal state with a simple means.

The object of the present invention is attained by a method of molding a low melting point metal alloy comprising the steps of, while using a metallic raw material that exhibits thixotropy properties in a solid-phase and liquid-phase coexisting temperature region as a molding material, heating said molding material at a temperature in the solid-phase and liquid-phase coexisting temperature region to form a semisolid material in a solid-phase and liquid-phase coexisting state, supplying a required amount of said semisolid material to a heating holding cylinder to be accumulated, and injecting said semisolid material into a mold by one shot from said heating holding cylinder, wherein a temperature of the heating holding cylinder is increased to a liquidus temperature or higher at the start of a molding operation, a remaining material in the preceding molding operation remaining in said heating holding cylinder in a solid state is wholly melted, said molding material is supplied to be temporarily molded while lowering the temperature of the heating holding cylinder to a temperature in the solid-phase and liquid-phase coexisting temperature region, and then a regular molding is started after the temperature has reached the solid-phase and liquid-phase coexisting temperature region. The melting of the remaining material can be carried out while stirring the material.

According to this invention, since the preceding molding material remaining in a heating holding cylinder as a solid is temporarily molded in a wholly molten metal state hardly having viscosity, to be removed from the heating holding cylinder, there being no adhesion of the material to an internal wall surface of the heating holding cylinder, an injection plunger or the like is used and the flow resistance with respect to forward and backward movements of the injection plunger is extremely small. As a result, all of the molding materials can be removed in a temperature-reducing process.

Further, in the present invention, the supply of the molding material is carried out after the start of temperature rise and the above-mentioned temporary molding is performed during this supply. Thus, while a temperature of the heating holding cylinder reaches a solid-phase and liquid-phase coexisting temperature region, a molten remaining material is replaced with a molding material and a regular molding can be immediately started after the temperature has reached the solid-phase and liquid-phase coexisting temperature region. Consequently, the start time of molding can be further shortened and the loss of material is further decreased than a case where a remaining material is melted and discharged and then the setting of a molding temperature is made and a material is supplied.

DESCRIPTION OF THE PREFERRED EMBODIMENTS

Figure 1:
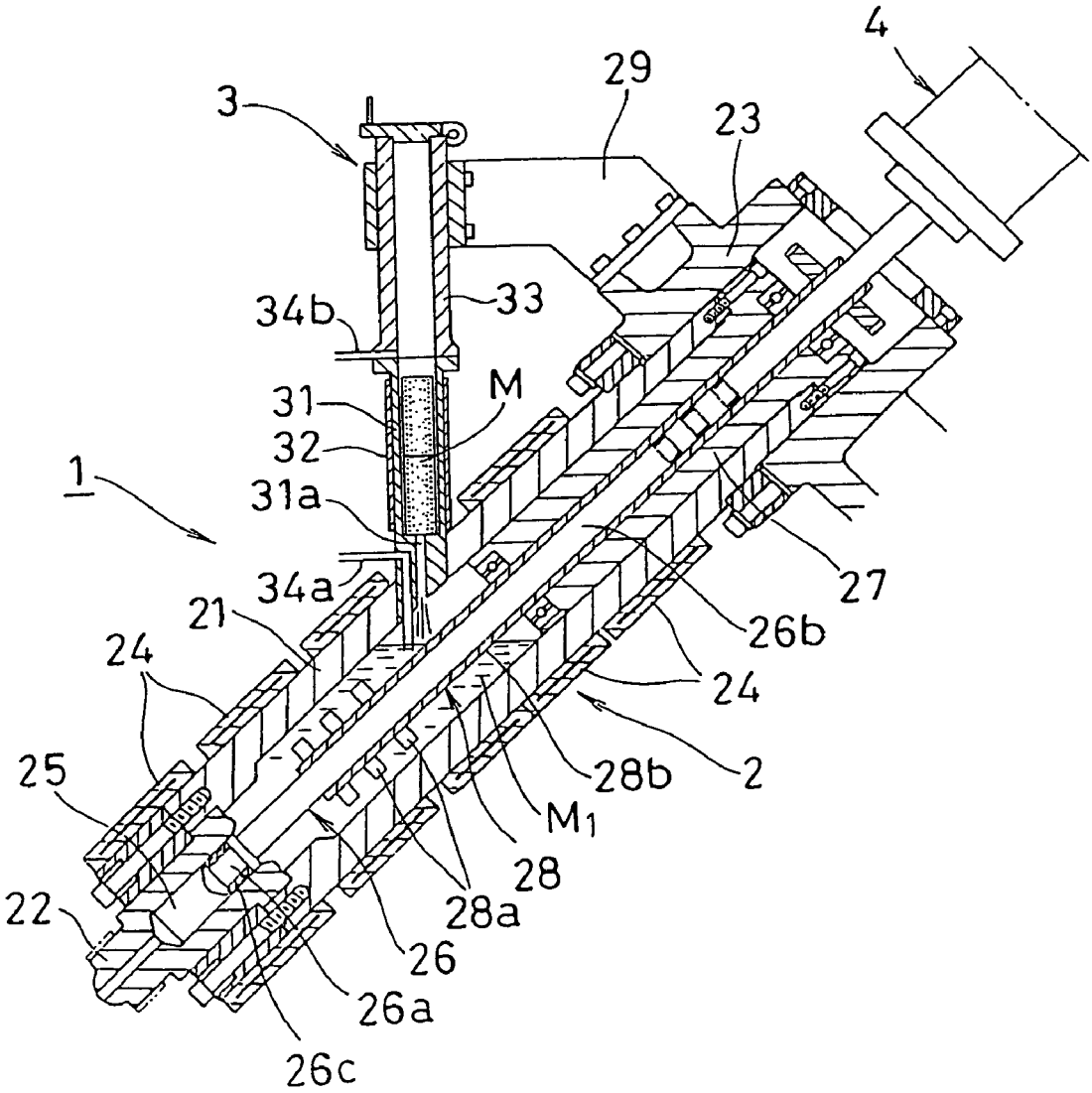
FIG. 1 is a vertical cross-sectional side view of an embodiment of a metal molding machine, which can adopt a molding method according to the present invention.

The reference numeral 1 in FIG. 1 denotes a metal molding machine. The metal molding machine 1 is comprised of a heating holding cylinder 2 having a nozzle member 22 at an end of a cylinder body 21, a melting and supply device 3 for a short columnar molding material M, and an injection drive 4 on a rear portion of the heating holding cylinder 2.

The molding material M consists of a solid cast into a columnar body (also called as a round bar) obtained by rapidly cooling a molten metal at a temperature in a solid-phase and liquid-phase coexisting temperature region and cooling a semi-molten alloy containing a finely spheroid solid phase, and consists of metallic raw material of a low melting point metal alloy, which becomes a semisolid, which exhibits thixotropy properties in a solid-phase and liquid-phase coexisting temperature region.

The heating holding cylinder 2 includes the melting and supply device 3 in a supply opening provided on a substantially middle upper side of the cylinder body 21, and a heating means 24 of a band heater on the outer circumference of the cylinder body. This heating means 24 is set at a temperature in the solid-phase and liquid-phase coexisting temperature region between a liquidus temperature and a solidus temperature of a low melting point metal alloy (for example, a magnesium alloy and an aluminum alloy) used as the molding material M.

The heating holding cylinder 2 is attached to a supporting member 23 at a rear end portion of the cylinder body, and is obliquely provided at an angle of 45° with respect to the horizontal plane together with the injection drive 4. The inside of the end portion communicating with the nozzle opening of the nozzle member 22 positioned downward by this slant arrangement of the heating holding cylinder 2, forms a measuring chamber 25. To the measuring chamber 25 is protrusively and retractively insertion-fitted an injection plunger 26*a* of an injection means 26, which is protrusively and retractively moved by the injection drive 4. This injection plunger 26*a* protrusively and retractively includes a check valve 26*c* in the outer circumference of which a seal ring is buried, on a circumference of the shaft portion, and the space between the check valve 26*c* and the shaft portion forms a flow passage for the semisolid material M1 not shown. The opening and closing of the flow passage is carried out by contact and separation between a rear end surface of the check valve 26*c* and the seat ring on a rear portion of the injection plunger.

A rod 26*b* of the injection means 26 is protrusively and retractively inserted into a hollow rotating shaft 28*b* in a stirring means 28 provided in the cylinder body while penetrated into a closing member 27 in the upper portion of the cylinder body 21. Further, a plurality of stirring blades 28*a* are provided on a circumference of an end portion of the rotating shaft 28*b*.

The melting and supply device forms a bottom portion by closing the inside of an end portion of an elongated pipe body, and is comprised of a melting cylinder 31 on the bottom portion of which a small-diameter supply flow passage through which a molten metal flows is provided, a heating means 32 such as a band heater, an induction heater or the like temperature controllably provided on the outer circumference of the melting cylinder 31 with a plurality of zones partitioned, and a supply cylinder 33 vertically connected to an upper portion of the melting cylinder 31. In the heating means 32 a low melting point metal alloy used as the molding material M is set at a liquidus temperature or lower.

It is noted that in a case where the molding material is granules such as chips or the like a hopper is provided on the upper end of the supply pipe 43.

Further, the melting and supply device 3 is vertically provided on the heating holding cylinder 2 by inserting the bottom portion side of the melting cylinder 31 into a material supply opening provided on the cylinder body 21 and attaching the supply cylinder 33 to an arm member 29 fixedly provided on the supporting member 23 and is provided with filling pipes 34*a* and 34*b* for inert gas such as argon gas in a portion from the lower portion to the inside of molten metal of the heating cylinder 2, and an upper space of the melting cylinder 31, respectively.

In the melting and supply device 3 when a molding material M for a number of shots is dropped from the upper opening of the supply pipe 31 to a bottom surface of the melting pipe 31, the molding material M is melted by heating from the circumference of the melting pipe 31. However, a molding material M including a spheroid solid phase gradually flows out of the supply passage 31*a* into the cylinder body 21 in a solid-phase and liquid-phase coexisting state prior to be wholly melted and is accumulated in a heating holding cylinder 2 heated at a liquidus temperature as the semisolid material Ml. The temperature of the accumulated semisolid material Ml is held at a temperature in a solid-phase and liquid-phase coexisting temperature region until the semisolid material Ml is injected after measurement. In case where the molding material M is a magnesium alloy (AZ 91D) a temperature of the heating means 32 is set at 560° C. to 590° C. and a heating means 24 of the heating holding cylinder 2 is set at 560° C. to 610° C.

A part of the semisolid material M1 accumulated in the heating holding cylinder 2 is allowed to flow into the measuring chamber 25 through the flow passage by the forced retreat of the injection plunger 26*a* and is accumulated in the measuring chamber 25 as one shot. After measuring, the semisolid material M1 is injected from the nozzle 22 to a mold not shown directly or through a hot runner by forced advance of the injection plunger 26*a* to be a required-shaped article.

The solid-phase fractions of the semisolid materials M1 are differentiated from each other by temperatures. However, a spherical solid phase is grown larger with the time passage irrespective of the difference between solid-phase and liquid-phase coexisting temperatures and consequently the solid-phase fraction is increased and the density of the solid phase in the liquid phase is also increased. In the above-mentioned magnesium alloy, the solid-phase fraction after holding the alloy for 30 min. at 570° C. becomes 69% and although the solid phase is generally grown largely a solid phase, which exceed 200μ is small, and the thixotropy properties are held. When the holding time exceeds 30 min., a solid-phase fraction, which exceeds 200μ is increased to reach even 75% or more whereby fluidity is decreased.

The semisolid material M1 accumulated in the heating holding cylinder 2 is the same as mentioned above. If the accumulation time is within 30 min., the measuring by forced retreat of the injection plunger 26*a* and the injection to the mold by forced advance can be smoothly performed without any trouble. However, when 30 min. has passed in the accumulation time, fluidity is lowered, and the flow passage is clogged with a largely grown solid phase, so that sending of the semisolid material M1 to the measuring chamber 25 by a retreat of the injection plunger 26*a* becomes worse. Thus the measuring of the semisolid material M1 every molding becomes unstable, which is liable to be a short shot due to the shortage of an injection amount of the semisolid material M1 into the mold.

If such a semisolid material M1 is not discharged so as not to be removed at the end of molding operation, it remains in the heating holding cylinder as a solid (not shown). Since this solid becomes a largely grown crystal by annealing, the structure of the crystal is hard and the crystal cannot be used by reheating at a temperature in the solid-phase and liquid-phase coexisting temperature region. Accordingly, it is necessary to remove the solid at the start of molding so that molding by supply of a new solid material can be made.

Figure 2:
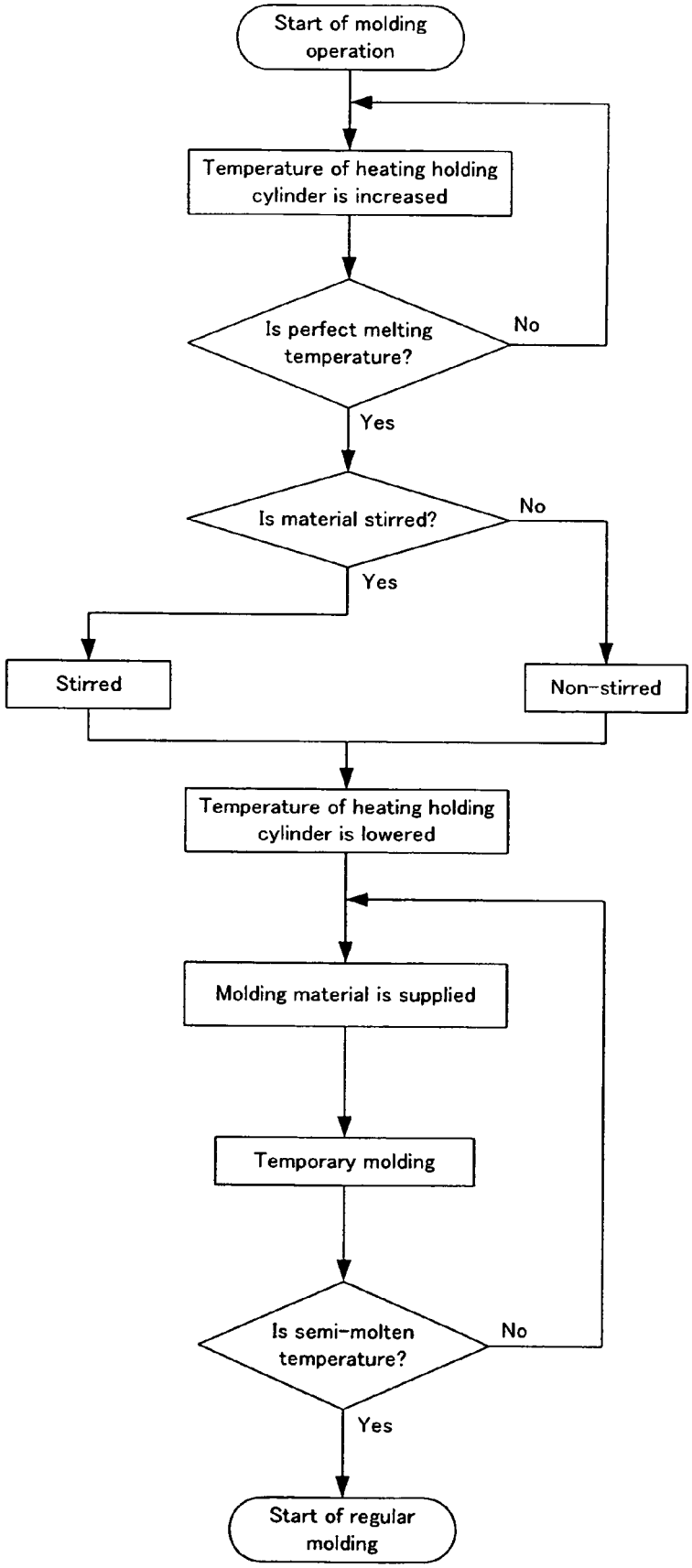
FIG. 2 is an explanatory view showing steps of a molding starting operation according to a molding method of the present invention.

FIG. 2 shows steps from the start of a molding operation to the start of a regular molding.

First, a temperature of the heating holding cylinder 2 in which the preceding molding material remains is increased to a liquidus temperature or higher. For a magnesium alloy (AZ 91D) as a remaining material, the temperature is increased to 620° C. to 650° C. so that the remaining material is wholly melted. Then it is confirmed whether stirring is needed or not in a process of this melting of the magnesium alloy. If necessary, the stirring means 27 is rotation-driven to be stirred so that the acceleration of melting and the dispersion of oxides in molten materials are carried out. If the all amounts of the remaining material are wholly melted, the temperature of the heating holding cylinder 2 is lowered to a temperature (560° C. to 610° C.) in a solid-phase and liquid-phase coexisting temperature region.

After the start of lowering temperature the supply of the molding material and temporary molding is started. The supply of the molding material is carried out by melting a molding material M into a semisolid material M1 by the melting cylinder 31. The temporary molding is carried out by repeating the measuring of the molding material by retreat moving of the injection molding means 26 and the injection of the material into a mold not shown by the advance of the injection means 26 until the temperature of the heating holding cylinder 2 reaches a temperature in the solid-phase and liquid-phase coexisting temperature region. Since the time of lowering temperature is long, all remaining materials melted within the time are removed from the inside of the heating molding cylinder by the temporary molding so that the material is replaced by a semisolid materials M1, which are continuously supplied. If the temperature of the heating holding cylinder 2 has reached a temperature in the solid-phase and liquid-phase coexisting temperature region after the replacement to the semisolid materials M1, regular molding is started.

What is claimed is:

1. A method of molding a low melting point metal alloy comprising the steps of, supplying a metallic raw material that exhibits thixotropy properties in a solid-phase and liquid-phase coexisting temperature region as a first molding material, heating said first molding material at a temperature in the solid-phase and liquid-phase coexisting temperature region to form a semisolid material in a solid-phase and liquid-phase coexisting state, supplying, in a first regular molding operation, a required amount of said semisolid material to a heating holding cylinder to be accumulated, and injecting said semisolid material into a mold by one shot from said heating holding cylinder, wherein, at the start of a next regular molding operation, the method further comprises, increasing a temperature of the heating holding cylinder to a liquidus temperature or higher, wholly melting any remaining material from a preceding molding operation remaining in said heating holding cylinder in a solid state, supplying additional first molding material to be temporarily molded in a temporary molding operation while lowering the temperature of the heating holding cylinder to a temperature in the solid-phase and liquid-phase coexisting temperature region, and then starting a next regular molding operation after the cylinder temperature has reached the solid-phase and liquid-phase coexisting temperature region.

2. The method of molding a low melting point metal alloy according to claim 1, wherein the melting of said remaining material is carried out while stirring the material.

* * * * *